United States Patent [19]

Koike

[11] Patent Number: 5,017,830

[45] Date of Patent: May 21, 1991

[54] COLOR CATHODE RAY TUBE HAVING A SHADOW MASK COVERED WITH A POROUS LAYER

[75] Inventor: Norio Koike, Hyougo, Japan

[73] Assignee: Kabushiki Kaisha Toshiba, Kawasaki, Japan

[21] Appl. No.: 401,238

[22] Filed: Aug. 31, 1989

[30] Foreign Application Priority Data

Oct. 27, 1988 [JP] Japan ..... 63-271648

[51] Int. Cl.[5] ..... H01J 29/07

[52] U.S. Cl. ..... 313/402; 313/403

[58] Field of Search ..... 313/402, 403

[56] References Cited

U.S. PATENT DOCUMENTS 4,665,338 5/1987 Inaba et al. ..... 313/402

4,734,615 3/1988 Koike et al. ..... 313/403 X

*Primary Examiner*—Sandra L. O'Shea

*Assistant Examiner*—Ashok Patel

*Attorney, Agent, or Firm*—Oblon, Spivak, McClelland, Maier & Neustadt

[57] ABSTRACT

A color cathode ray tube having a vacuum envelope including a panel with an inner surface, a neck and a funnel connecting the neck to the panel, a phosphor screen provided on the inner surface of the panel for emitting visible light, an electron gun provided in the neck for emitting a plurality of electron beams towards the phosphor screen, a shadow mask provided adjacent to the phosphor screen with a predetermined distance from the phosphor screen, and a porous layer, which is formed on a surface of the shadow mask facing to the electron gun. The porous layer is formed by using metal alkoxide solution which contains black color pigment containing both of cobalt oxide and nickel oxide.

3 Claims, 2 Drawing Sheets

COLOR CATHODE RAY TUBE HAVING A SHADOW MASK COVERED WITH A POROUS LAYER

BACKGROUND OF THE INVENTION

This invention relates to a color cathode ray tube and more particular, relates to a shadow mask covered with a porous layer.

Generally, a shadow mask type color cathode ray tube includes an electron gun emitting three electron beams, a phosphor screen, which is formed on an inner surface of a panel of an envelope and includes phosphor layers emitting red, green and blue light by bombardment of the electron beams, respectively, and a shadow mask provided in front of the phosphor screen with predetermined distance for selectively directing the electron beams so as to bombard the predetermined phosphor layers, respectively. In the cathode ray tube, reproduced images are observed through the panel. The shadow mask with a plurality of apertures is placed so as to have relationship that the apertures correspond to the phosphor layers, accurately.

In the cathode ray tube, the amount of effective electron beams passing through the apertures is ⅓ or less of the total amount of the electron beams emitted from the electron gun. The remainder of the electron beams are converted to thermal energy by bombarding the shadow mask. Thus, the shadow mask is heated up to the order of 80° C. during the operation of a normal TV set. Moreover, in the special color cathode ray tube used in display such as in aircraft cockpits, the temperature of the shadow mask sometimes rises to about 200° C.

Generally, such shadow mask is formed from thin plate with thickness of 0.1mm–0.3mm composed of so-called cold rolled steel with a thermal expansion coefficient as large as $1.2\times10^{-5}/°$ C. The shadow mask also has blackened film which is formed on the surface of the plate. The shadow mask is fixed to a mask frame in the envelope by securing a skirt portion of the shadow mask. The mask frame is formed from the same cold rolled steel with L-shaped cross-section of about 1 mm on which a blackened film is formed.

When the shadow mask is heated by the electron beams, the temperature of the peripheral portion of the shadow mask is lower than that of the central portion of the shadow mask since the peripheral portion is contacted with the mask frame with a large thermal capacity, so that the heat at the peripheral portion can be easily transmitted due to radiation and conduction. As the result, a temperature difference occurs between central portion and peripheral portion of the shadow mask, and a so-called doming phenomenon consequently occurs. When the doming phenomenon occurs, the distance between the shadow mask and the phosphor screen changes, and the color purity deteriorates due to disturbance to the accurate landing of the electron beams. This type of mislanding due to the doming phenomenom is remarkably during initial stage of the operation of the tube. Also, when an image including a high brightness portion is reproduced and the portion stops for a while, a local doming phenomenon occurs.

For settlement of the doming phenomenon by promotion of heat radiation from the central portion of the shadow mask, many proposals have been made. For example, it has been proposed in U.S. Pat. No. 2,826,538 that the shadow mask has a black layer consisting of graphite. Since the black layer acts as a good radiator, such temperature non-uniformity in the shadow mask can be prevented in some extent. However, since the adhesion of the black layer is reduce due to temperature changes during the heat treatment processing in the tube manufacturing process, and small pieces drop off by partial peeling due to the external vibration of the rube. The small pieces cause deterioration of the picture quality in the phosphor screen by blocking the apertures of the shadow mask. Further, the pieces cause deterioration in the withstand voltage characteristic by inducing sparking between the electrodes of the electron gun. Consequently, the quality of the color cathode ray tube is remarkably reduced due to the pieces.

Another proposal has been described in U.S. Pat. No. 4,716,333 in order to prevent the doming phenomenon by increasing the mechanical strength of the shadow mask. According to the patent, the shadow mask has a layer of lead borate glass which is bonded to the surface of the shadow mask and is formed by high-temperature heat treatment. The shadow mask can remarkably reduce the doming phenomenon due to the glass layer. However, since the glass layer contains lead with a large atomic number, it is difficult to reduce the elastic rebound of the electron beams which bombard the shadow mask.

Furthermore, it has been proposed in U.S. Pat. No. 4,734,615 that a shadow mask has a layer with a good heat dissipation property formed on the surface of the mask. The layer comprises a metal or metal oxide as a filler and an amorphous metal oxide as a binder.

SUMMARY OF THE INVENTION

One object of this invention is to provide a color cathode ray tube with good quality.

Another object of the invention is to provide a color cathode ray tube with good picture quality by preventing the doming phenomenum.

Further object of the invention is to provide a color cathode ray tube with an improved emission characteristic.

Therefore, the invention may provide a cathode ray tube comprising a vacuum envelope including a panel with an inner surface, a neck and a funnel connecting the neck to the panel, a phosphor screen provided on the inner surface of the panel for emitting visible light, an electron gun provided in the neck for emitting a plurality of electron beams towards the phosphor screen, a shadow mask provided adjacent to the phosphor screen with a predetermined distance from the screen and having a front surface facing to the phosphor screen, a rear surface facing to the electron gun and a plurality of apertures for allowing passage of the electron beams towards the screen, and a porous layer provided on at least one of the front and rear surfaces of the shadow mask. The porous layer is formed by using a solution of metal alkoxide solution containing black pigment which contains both of cobalt oxide and nickel oxide.

A color cathode ray tube of this invention has superior characteristic compared with a color cathode ray tube described in U.S. Pat. No. 4,734,615 mentioned above. Namely, since the porous layer covering the surface of the shadow mask is formed by the solution which includes black color group pigments containing both of cobalt oxide and nickel oxide, the porous layer has a greater pore diameter distribution and a smaller cumulative pore capacity, according to the invention. Therefore, the oxidizing gases, such as $H_2O$, $CO_2$ and CO, which are adsorbed to the porous layer and will deteriorate the emission characteristic of the oxide cathode of the electron gun, can be easily exhausted in the air evacuation process during the tube manufacturing process. Consequently, according to the invention, the porous layer on the surface of the shadow mask can improve the heat dissipation characteristic of the shadow mask due to the black color group pigments and thus can suppress the doming phenomenon, effectively. Also, the porous layer can improve the emission characteristic of the cathode of the electron gun.

On the contrary, the film shown in U.S. Pat. No. 4,734,615 consists of a porous film containing hydroxyl groups (—OH). since the film is formed by a suspension containing amorphous metal oxide contained in metal alcoholate, as a binder. Accordingly, the film absorbs the gases emitted during heating and drying when forming the film itself and the gases contained in the atmospheric air to which the film is exposed during the manufacturing process of the tube. It, however, is not easy to exhaust these gases from the film.

The porous layer of this invention is composed of a film formed from metal alcoholate in the same way as the film mentioned in the patent. However, since the pigments used in the invention contain both of cobalt oxide and nickel oxide, the pH of the solution which hydrolyses the alcoholate is large (this means that the solution is basic solution) during film formation, and thus the pore diameter distribution is larger and the cumulative pore capacity is smaller comparing with that of the film described in U.S. Pat. No. 4,734,615. As the result, since the gases, such as the oxidizing gases, which have been adsorbed, can be easily exhausted, the emission characteristic of the electron gun can be improved.

The cumulative pore capacity means a volume of the space portion per units weight of the porous layer formed on the shadow mask, that is to say it indicates the total volume of the pores in the layer. This means that the smaller the cumulative pore capacity, the smaller the volume of the pores. Therefore, it is desirable for the porous layer that the absorption of the undesirable gas is small due to less total volume of the pores and the gases can be easily exhausted due to large diameter of the pore. In other words, the film, which has a large pore diameter distribution and a small cumulative pore capacity, is desirable for the porous layer of the invention.

According to the invention, it is preferable that both ranges of the pore diameter distribution (r) and the cumulative pore capacity (V) simultaneously satisfy following equations, respectively.

$$3000\text{Å} \leqq r \leqq 7000\text{Å}$$

$$200\text{mm}^3/\text{g} \leqq V \leqq 500\text{mm}^3/\text{g}$$

Since it is hard to exhaust the oxidizing gases absorbed in the porous layer, it is not preferable for practical use of the porous layer if r is not greater than 3000Å. Since tightness of the porous layer is deteriorated, it is not preferable for practical use of the porous layer if r is not smaller than 7000Å. Also, since amount of the gases absorbed in the porous layer increases, it is not preferable for the porous layer, practically, if V is not smaller than $500\text{mm}^3/\text{g}$. It is not preferable for the porous layer, practically, if V is not greater than $200\text{mm}^3/\text{g}$, since amount of hydrogen gas emitted from the porous layer decreases due to decreased amount of residual hydroxyl groups (—OH).

For the contents of the oxides of Co and Ni in the black color pigments, it is desirable for the pigments contain 1.0 wt% to 15 wt% of cobalt oxide and nickel oxide, respectively. If the amount of cobalt oxide and nickel oxide exceed 15 wt%, respectively, it is undesirable since the amount of $Fe^{+++}$, $Mn^{++}$, $Mn^{+++}$, which realize the sharpness of absorption characteristic of the pigments, reduces. If the amount is less than 1.0 wt%, the basicity of the solution used to form the porous layer is not exhibited. Also, it is desirable to adjust the ratio of CoO to NiO to mole ratio of 1:1, since the Ni ion acts as $Ni^{++}$ when forming the porous layer.

Furthermore, since the porous layer of this invention includes hydroxyl groups (—OH), hydrogen gas ($H_2$), which is reductive gas, is emitted from the layer when the layer is bombarded by the electron beams. As described in the following equation, since BaO in the oxide cathode is reducted by the hydrogen gas, the emission characteristic of the electron gun is improved.

$$BaO + H_2 \rightarrow Ba + H_2O$$

DETAILED DESCRIPTION OF PREFERRED EMBODIMENT

Figure 1:
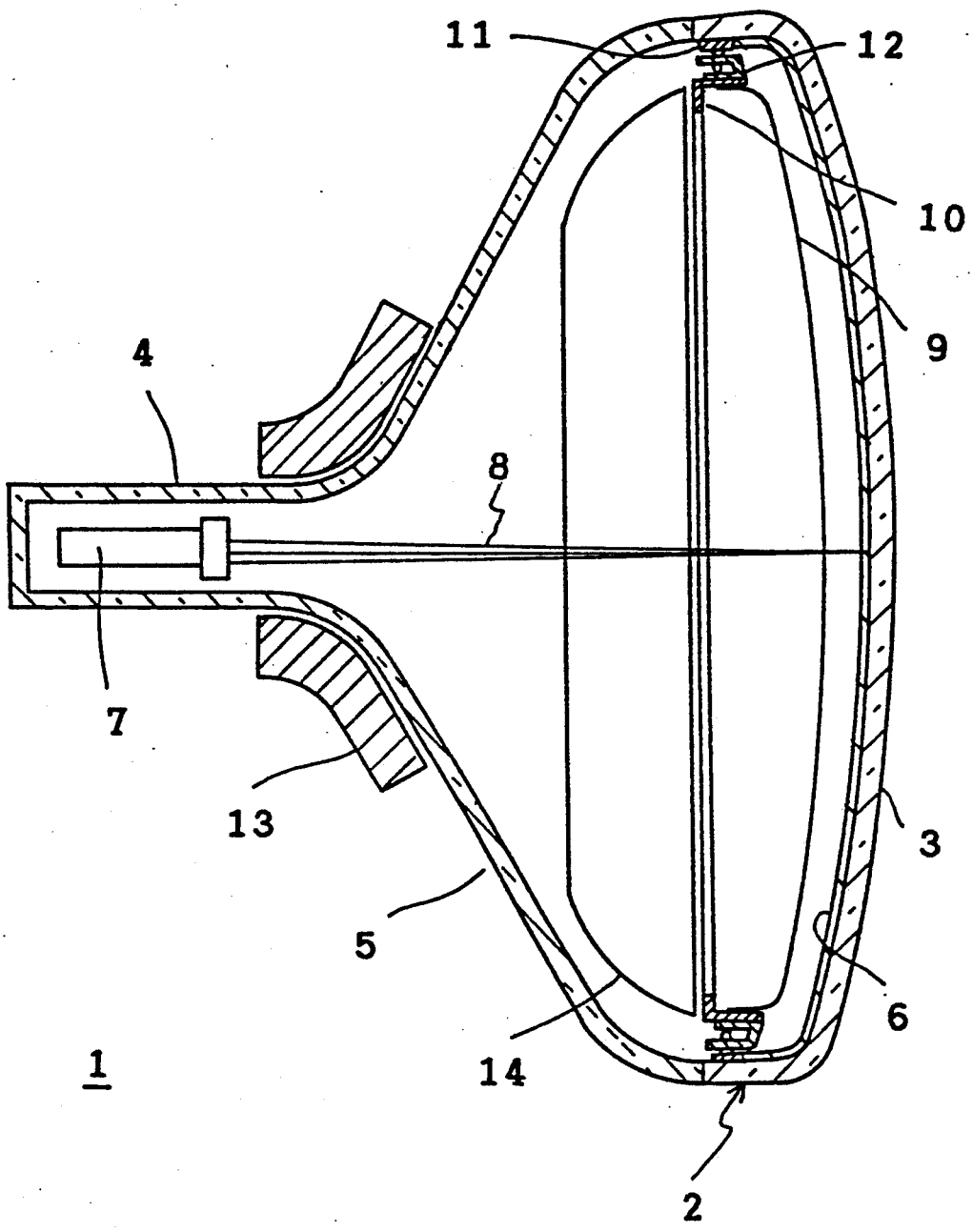
FIG. 1 shows a sectional view of a color cathode ray tube in accordance with one embodiment of the invention.

Preferred embodiment of this invention will be explained with reference to the drawings. In FIG. 1, a color cathode ray tube I includes an envelope 2 which has a rectangular panel 3, a neck 4 and a funnel 5 connecting the neck 4 to the panel 3. On an inner surface of the panel 3, a phosphor screen 6, which includes a plurality of phosphor stripes for emitting red, green and blue lights, respectively, is formed. In the neck 4, is provided an inline type electron gun 7, which emits three electron beams 8 aligned in a direction along a horizontal axis of the panel 3 for bombarding the phosphor stripes, respectively. Also, a shadow mask 9, which has a plurality of apertures **9*b* arranged in lines in the vertical direction and horizontal direction, is supported near the phosphor screen 6 by a mask frame 10. The mask frame 10 is secured by stud pins 11 which are embedded in a skirt of the panel 3 through elastic members 12**.

A deflection yoke 13 is provided on the outside of the funnel 5 for deflecting the electron beams 8 so that the electron beams scan the phosphor screen 6. Furthermore, an inner shield 14, which is composed of a ferromagnetic metal plate is fixed to the mask frame 10 so as to surround a path of the electron beams 8.

Figure 2:
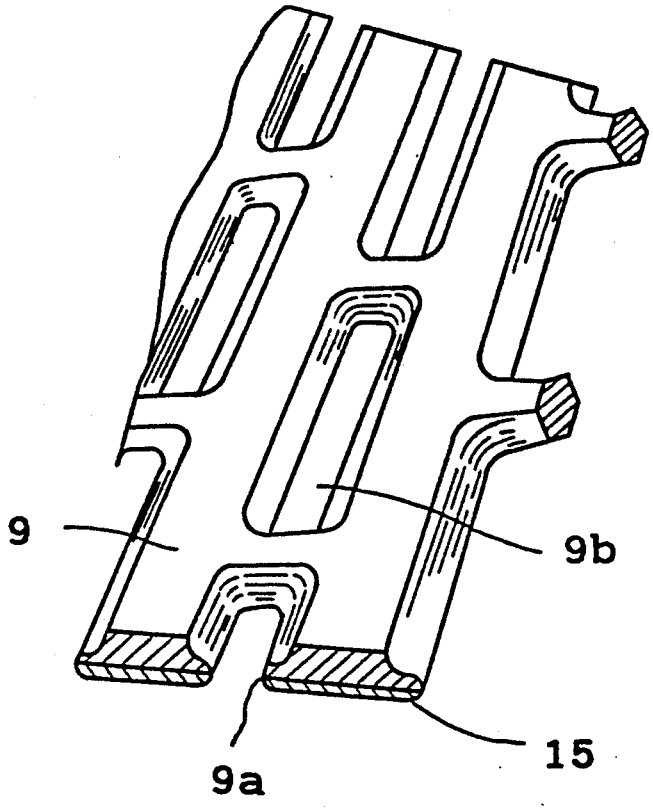
FIG. 2 shows a perspective view of the shadow mask shown in FIG. 1.

As shown in FIG. 2, on a rear surface **9*a* of the shadow mask 9 facing to the electron gun, is formed a porous layer 15, which is formed from a mixed layer of metal oxide of amorphous silicon and zirconium, metallic hydroxides and black color pigments containing both of cobalt oxide and nickel oxide. The porous layer 15 was formed in the following manner. At first, a solution, which had the constituents give below, was prepared. For the pigment, the inorganic pigments shown in Table 1** was used. The mean particle diameter of these pigments was adjusted to 0.7 μm.

| | |
|---|---|
| Pigment | 350 g |
| Alcoholate compounds of silicon and zirconia | 200 g |
| Iso-propyl alcohol (IPA) | 450 g |

This solution was coated on the rear surface of the shadow mask to have a thickness of 15μm by spray method. Finally, the porous layer gas obtained by heating the shadow mask in an atmosphere at a temperature more than 70° C. During the heating, hydrolysis was caused in the alcoholate compounds of silicon and zirconia coated on the shadow mask by moisture contained in the atmosphere. Thus, by the condensation polymerization reaction between the alkoxides a film was formed and, finally, the porous layer composed of a mixed layer of metal oxide of amorphous silicon and zirconium, metallic hydroxides and black color pigments.

For comparative example, the porous layers were formed in the same manner as in the embodiment for the various types of the pigments in Table 1.

TABLE 1

| | Pigment Composition (wt %) | | | | | pH of solution when mixed with pure water (pH = 7.1) |
|---|---|---|---|---|---|---|
| | $Fe_2O_3$ | $MnO_2$ | CoO | $CrO_3$ | NiO | |
| Embodiment 1 | 66.8 | 26.9 | 3.2 | — | 3.1 | 9.3 |
| Embodiment 2 | 69.0 | 29.1 | 1.0 | — | 0.9 | 8.9 |
| Embodiment 3 | 55.7 | 14.6 | 14.8 | — | 14.9 | 9.8 |
| Comparative Example 1 | 73.1 | 26.8 | — | — | — | 7.5 |
| Comparative Example 2 | 39.5 | 16.7 | 13.3 | 30.5 | — | 7.8 |
| Comparative Example 3 | 57.5 | 39.2 | 3.3 | — | — | 7.3 |
| Comparative Example 4 | 34.1 | 29.8 | — | 36.1 | — | 8.0 |

The shadow masks with the porous layers were incorporated in color cathode ray tubes with 21 inches-size screen, respectively. After the tubes were continuously operated for 3000 hours, residual emission coefficients were measured. The results are shown in Table 2.

TABLE 2

| | Residual Emission Coefficient after 3000 hours |
|---|---|
| Embodiment 1 | 115% |
| Embodiment 2 | 102% |
| Embodiment 3 | 122% |
| Comparative Example 1 | 83% |
| Comparative Example 2 | 85% |
| Comparative Example 3 | 85% |
| Comparative Example 4 | 84% |

Furthermore, after the residual emission coefficient test, the tubes were dismantled and the porous layers were peeled off for measuring the pore diameter distributions and the cumulative pore capacities. The measurement was done for the pores with diameter between 40 Å and 75000 1Å by the mercury porosimeter method. The results are shown in Table 3.

TABLE 3

| | Mean Pore Diameter | Cumulative Pore Capacity |
|---|---|---|
| Embodiment 1 | 4000Å | 450 $mm^3/g$ |
| Comparative Example 2 | 3000Å | 550 $mm^3/g$ |

As is clear from the results of these measurement, the residual emission characteristic of the tubes according to the embodiments are improved. The mean pore diameter of the porous layer according to the embodiments were greater than that of the comparative examples. Also, the cumultative pore capacity were smaller than that of the comparative examples.

In the above embodiments, (Fe, Mn, Co, Ni)O black group pigments was used. Similar results can be obtained when (Fe, Mn, Co, Ni, Si)O black pigments is used.

What is claimed is:

1. A color cathode ray tube comprising:

a vacuum envelope including a panel with an inner surface, a neck and a funnel connecting the neck to the panel;

a phosphor screen provided on the inner surface of the panel for emitting visible light;

an electron gun provided in the neck for emitting a plurality of electron beams towards the phosphor screen;

a shadow mask provided adjacent to the phosphor screen with a predetermined distance from the phosphor screen and having a front surface facing to the phosphor screen, a rear surface facing to the electron gun and a plurality of apertures for allowing passage of the electron beams towards and screen; and a porous layer provided on at least one of the front and rear surfaces of the shadow mask and being formed by using metal alkoxide solution containing black pigment, the pigment containing 1.0 wt.% to 15wt.% cobalt oxide and 1.0 wt.% to 15wt.% nickel oxide wherein the weight ratio of cobalt oxide to nickel oxide is about 1.

2. A color cathode ray tube according to claim 1 wherein the pigment contains manganese dioxide and iron oxide.

3. A color cathode ray tube according to claim 1 wherein the porous layer is capable of emission of hydrogen gas when the porous layer is bombarded by the electron beams.

* * * * *